US009697973B2

(12) United States Patent
Liang et al.

(10) Patent No.: US 9,697,973 B2
(45) Date of Patent: Jul. 4, 2017

(54) STRUCTURE ELECTROMAGNETIC RELAY CONTAINING PERMANENT MAGNET

(71) Applicant: HARBIN INSTITUTE OF TECHNOLOGY, Heilongjiang (CN)

(72) Inventors: Huimin Liang, Heilongjiang (CN); Yong Xie, Guangxi (CN); Jiaxin You, Heilongjiang (CN); Guoqiang Xie, Guangxi (CN)

(73) Assignee: HARBIN INSTITUTE OF TECHNOLOGY, Heilongjiang (CN)

( * ) Notice: Subject to any disclaimer, the term of this patent is extended or adjusted under 35 U.S.C. 154(b) by 81 days.

(21) Appl. No.: 14/396,056

(22) PCT Filed: Oct. 15, 2013

(86) PCT No.: PCT/CN2013/001253
§ 371 (c)(1),
(2) Date: Oct. 22, 2014

(87) PCT Pub. No.: WO2014/079143
PCT Pub. Date: May 30, 2014

(65) Prior Publication Data

US 2015/0303017 A1 Oct. 22, 2015

(30) Foreign Application Priority Data

Nov. 23, 2012 (CN) ..... 2012 1 0483141

(51) Int. Cl.
*H01H 51/29* (2006.01)
*H01H 51/01* (2006.01)
(Continued)

(52) U.S. Cl.
CPC ..... *H01H 51/29* (2013.01); *H01H 50/041* (2013.01); *H01H 50/047* (2013.01);
(Continued)

(58) Field of Classification Search
CPC ..... H01H 51/29; H01H 50/14; H01H 50/047; H01H 50/36; H01H 2235/028
(Continued)

(56) References Cited

U.S. PATENT DOCUMENTS 6,204,740 B1 * 3/2001 Nakahata ..... 335/4
6,211,756 B1 * 4/2001 Sun et al. ..... 335/4
7,872,551 B2 * 1/2011 Nakamura et al. ..... 335/4

FOREIGN PATENT DOCUMENTS

CN 201051475 Y 4/2008
CN 201084654 Y 7/2008
(Continued)

OTHER PUBLICATIONS

International Search Report for PCT/CN2013/001253.

*Primary Examiner* — Bernard Rojas
(74) *Attorney, Agent, or Firm* — The PL Law Group, PLLC

(57) ABSTRACT

A novel-structure electromagnetic relay containing a permanent magnet. At least three pairs of leading-out rods penetrate through a rectangular base, two pairs of leading-out rods are connected with the lower ends of four static spring plates respectively, an iron core and a coil framework are arranged at a diagonal position on the upper surface of the base, winding connectors of coils are connected with the other pair of leading-out rods respectively, the static spring plates are arranged at the other diagonal position on the upper surface of the base, a support is arranged at the top end of the coil framework, a pole face, a yoke and the permanent magnet are installed on the support, an armature, movable spring plates, the pole face and the yoke are located and connected through a middle shaft, and a sealing casing is covered outside the relay.

4 Claims, 5 Drawing Sheets

(51) Int. Cl.
*H01H 50/04* (2006.01)
*H01H 50/14* (2006.01)
*H01H 50/36* (2006.01)

(52) U.S. Cl.
CPC ..... *H01H 50/14* (2013.01); *H01H 50/36* (2013.01); *H01H 51/01* (2013.01); *H01H 2050/044* (2013.01); *H01H 2235/028* (2013.01)

(58) Field of Classification Search
USPC ..... 335/177, 179, 180
See application file for complete search history.

(56) References Cited

FOREIGN PATENT DOCUMENTS

| | | | |
|---|---|---|---|
| CN | 103000454 | A | 3/2013 |
| JP | 2012094732 | A | 5/2012 |

* cited by examiner

STRUCTURE ELECTROMAGNETIC RELAY CONTAINING PERMANENT MAGNET

CROSS REFERENCE TO RELATED APPLICATIONS AND CLAIM OF PRIORITY

This patent application claims benefit under 35 U.S.C. 119(e), 120, 121, or 365(c), and is a National Stage entry from International Application No. PCT/CN2013/001253, filed 15 Oct. 2013, which claims priority to Chinese Patent Application No. 201210483141.4, filed 23 Nov. 2012, entire contents of which are incorporated herein by reference.

CROSS REFERENCE TO RELATED APPLICATIONS AND CLAIM OF PRIORITY

This patent application claims benefit under 35 U.S.C. 119(e), 120, 121, or 365(c), and is a National Stage entry from International Application No. PCT/CN2013/001253, filed 15 Oct. 2013, which claims priority to Chinese Patent Application No. 201210483141.4, filed 23 Nov. 2012, entire contents of which are incorporated herein by reference.

TECHNICAL FIELD

The present invention relates to the electromagnetic relay, in particular relates to a novel-structure electromagnetic relay containing a permanent magnet.

BACKGROUND

Electromagnetic relay has a wide range of applications in the area of aerospace, defense and civilian, and play roles of control, detection, protection and regulatory, and is one of the most basic electrical devices. The electromagnetic relay usually contains a permanent magnet in order to improve the sensitivity of the relay, to reduce the power consumption, its size, and its weight. One type of permanent magnets used in permanent-magnet relays provides a return force. And the other type is used as the armature component, involving the entire process of the relay action. However, currently these two types of permanent magnet relays have the following deficiencies: for the first type of electromagnetic relay with permanent magnets, most of its armature structures are asymmetry in order to achieve the closed magnetic circuit of the permanent magnet, So the index of the resistant centrifugal acceleration of the relay is lower, for the second type of the electromagnetic relay with a permanent magnet, it's difficult to adjust it, its productivity is low, and it is hard to assure its quality; In the other hand, for the armature is arranged coaxially with the static reed, the space utilization is low, the size of the static springs is limited, and the switch capacity of the relay is small.

SUMMARY OF THE INVENTION

The present invention provides a new type of structure design of the electromagnetic relay with a permanent magnet to overcome many shortcomings of the return springs, and further to improve the switch capacity of the electromagnetic relay with a permanent magnet, to enhance the space utilization and to reduce the volume of the relay.

The technical proposal of said present invention is: An electromagnetic relay containing a permanent magnet, comprising a base and terminal rods, an iron core and a coil bobbin, static springs, pole surfaces and yokes, armatures, movable springs, a bracket, the permanent magnet, connecting blocks, a middle axis and a sealed housing, wherein, at least three pairs of the terminal rods pass through the base which is rectangular, wherein, two pairs of the terminal rods are respectively connected to the lower ends of four static springs, the iron core and the coil bobbin are installed at a diagonal position on the upper surface of the base, wound wire contacts of coils are respectively connected to the further third pair of the terminal rods, the static springs are mounted at the other diagonal position on the upper surface of the base, the bracket is mounted at the top of the coil bobbin, the pole surfaces and the yokes, and the permanent magnet are installed on the bracket; the armature, the movable springs, the pole surfaces and the yokes are located and connected by a middle axis, and the outside of the electromagnetic relay is covered by the sealed housing.

The structure of said pole surfaces and said yokes is: there are a pair of large yokes and a pair of pole surface each connected with a corresponding large yoke, each large yoke is connected with one pole surface, and there are a pair of small yokes and a pair of pole surface each connected with a corresponding small yoke, each small yoke is connected with the other pole surface, the pair of large yokes and the pair of small yokes are centrally symmetrically disposed on the bracket; the pole surface connecting with each large yoke and the pole surface connecting with each small yoke are disposed opposite to each other at a given distance, and downwardly bent ends at both ends of the armature are disposed within the distance between the former pole surfaces and the latter pole surfaces, the other end of each large yoke is butt jointed with the end of the permanent magnet and also connected to one pole surface, the other end of each small yoke is connected with the top of the iron core and the coil bobbin.

Said armature, said movable springs and said connecting block form a cross armature trigger structure, the cross armature trigger structure is centered at the connecting block which is square, there are through-holes at the center of the connecting block to install rotating shafts, and there are concave recesses carved in surrounding walls of the connecting block, the armature is shoulder-pole shape, which is fixed by rivets and the connecting block, two bow-shaped metal sheets with arc-shaped protrusions at the ends are used as the movable springs, and are fixed by the concave recesses, external sides of which are symmetrically embedded into the side walls of the connecting block; the permanent magnet is installed under the connecting block, and there are through holes to install rotating shafts at the center of said permanent magnet, the magnetizing polarity direction of the permanent magnet is consistent with the installation direction of the movable springs, and perpendicular to the direction of the armature; when the cross armature trigger structure moves, the permanent magnet does not rotate along with it.

In the electromagnetic relay, a pair of normally open contacts consist of the movable springs and a pair of the static springs at a diagonal position, and a pair of normally closed contacts consist of said movable springs and the other pair of the static springs at the other diagonal position.

Said present invention applies a new structure with a permanent magnet system to avoid many shortcomings of the return spring, and produce the forces at the position of both close and open. For the movable springs and the armature are installed crossly at 90°, the height of said relay type is reduced extremely, on the other hand, the width of static spring is increased, and switch capacity of said type of relay is improved for installing space of the static spring plates is enlarged. In the meantime, the cross installation mechanism of the movable springs and the armature may make the static springs and coil be installed on two diagonals of the relay base respectively to improve space utilization, and reduce the volume of said relay.

DETAILED DESCRIPTION OF THE EMBODIMENTS

Figure 1:
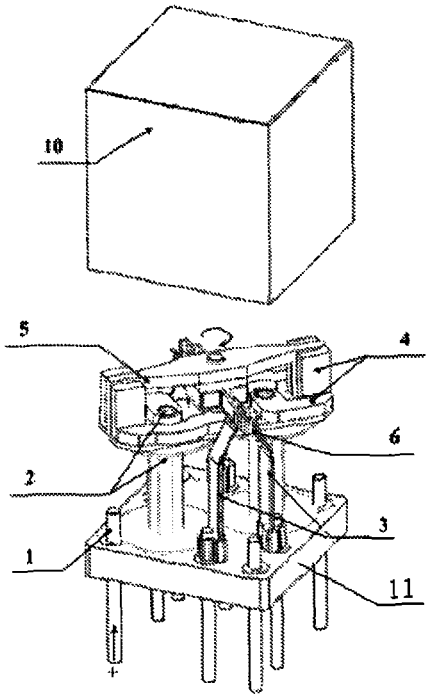
FIG. 1 is a schematic diagram of the overall three-dimensional structure of said present invention (disassembling the housing).
Figure 2:
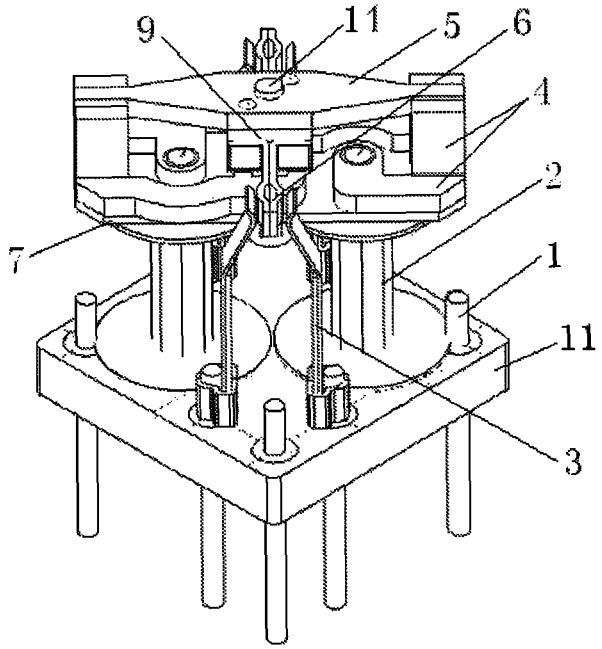
FIG. 2 is a schematic diagram of the overall three-dimensional structure of said present invention after removing the cover.
Figure 3:
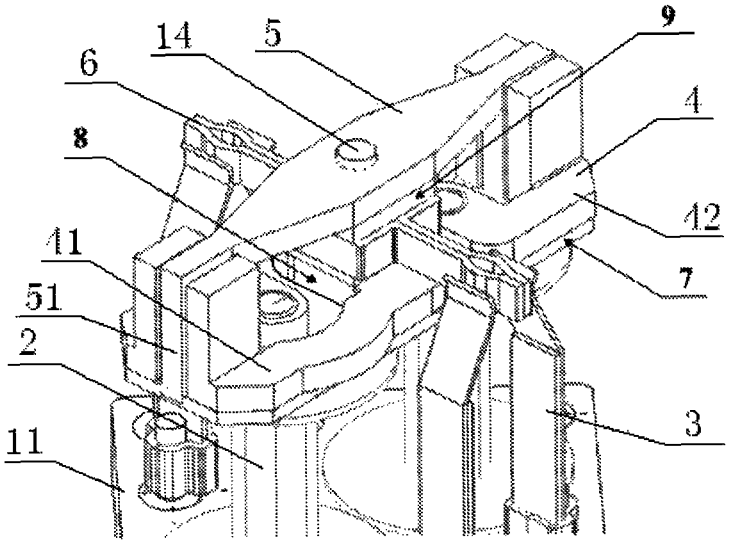
FIG. 3 is a partial enlarged view of the upper portion of FIG. 2.
Figure 4:
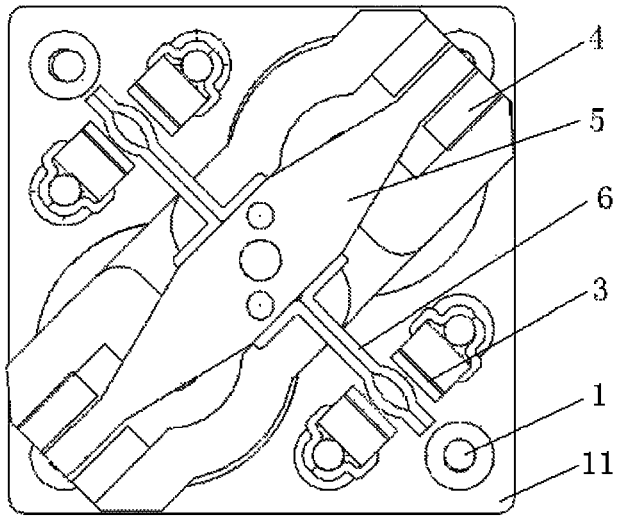
FIG. 4 is a top view of FIG. 2.

Referring to FIG. 1-FIG. 8, said present invention is a novel-structure electromagnetic relay containing a permanent magnet, comprising the base 11 and several terminal rods 1 passing through the base 11, iron cores and coil bobbins 2 (coils are wound round the coil bobbin, but not indicated on the drawing), static springs 3, and the pole surfaces and the yoke 4, the armature 5, the movable spring 6, the bracket 7, the permanent magnet 8, connecting block 9 and sealed housing 10.

The terminal rods a, b, c, d of the terminal rod 1 on the base 11 are respectively connected with the four static springs 3, the iron core and the coil bobbin 2 are mounted at a diagonal position on the upper surface of the base 11 (which be fixed with screws in the two through-holes 13 of a diagonal position), wound wire contacts of coils are respectively connected with two terminal rods e, f at a diagonal position of the base 11 separately, static spring 3 are mounted at the other diagonal position of the base 11. The bracket 7 is mounted at the top end of the coil bobbin 2, the pole surface and the yoke 4, and the permanent magnet 8 are installed on the bracket 7; the armature 5, the movable spring 6, the pole surfaces and the yoke 4 are located and connected through a middle axle 14, and the outside of the electromagnetic relay is covered by the sealed housing 10.

Figure 7:
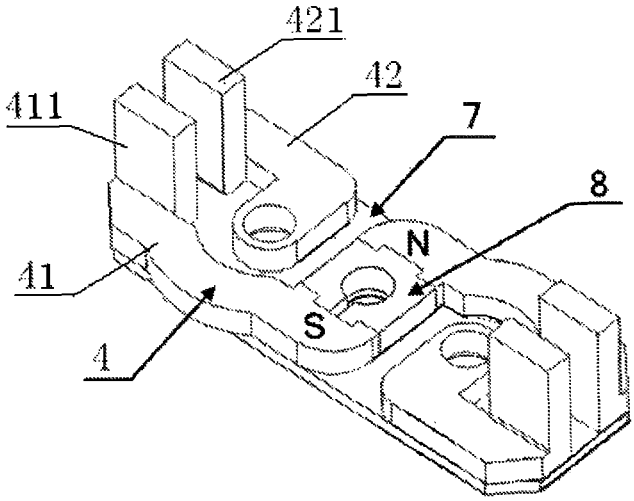
FIG. 7 is a three-dimensional structure schematic diagram of the pole surfaces, the yokes, the permanent magnet and the bracket of said present invention.
Figure 8:
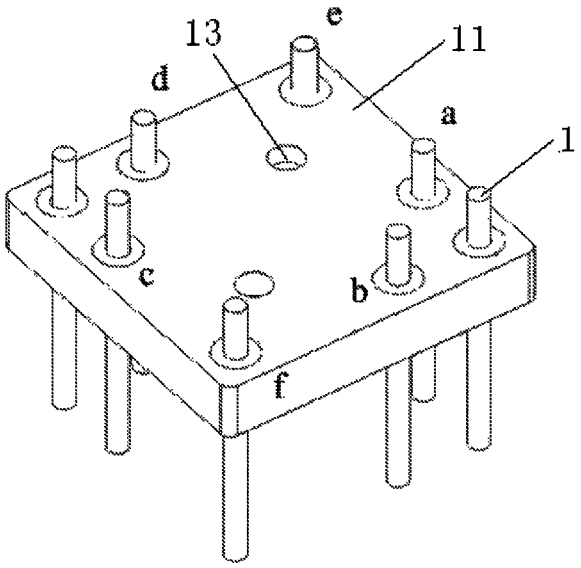
FIG. 8 is a three-dimensional structure schematic diagram of the base and terminal rods.

Referring to FIG. 7, the structures of the pole surface and the yoke 4 are that, a large yoke 41 is connected with one pole surface 411, a small yoke 42 is connected with the other pole surface 421. There are a pair of large yokes 41 and a pair of pole surfaces 411 each connecting with a corresponding large yoke 41, and the two pairs are centrally symmetrically disposed on the bracket 7. There are a pair of small yokes 42 and a pair of the pole surfaces 421 each connecting with a corresponding small yoke 42, and the two pairs are centrally symmetrically disposed on the bracket 7. The pole surfaces 411 connecting with the large yokes 41 and the pole surfaces 421 connecting with the small yokes 42 are disposed opposite to each other at a given distance, and downwardly bent ends at both ends of the armature 5 are disposed within the distance between the former pole surfaces and the latter pole surfaces. The other end of the large yoke 41 is butt jointed with the end of the permanent magnet 8 and also connected to one pole surface 411, the other end of the small yoke 42 is connected with the top core of the iron core and the coil bobbin 2.

Figure 5:
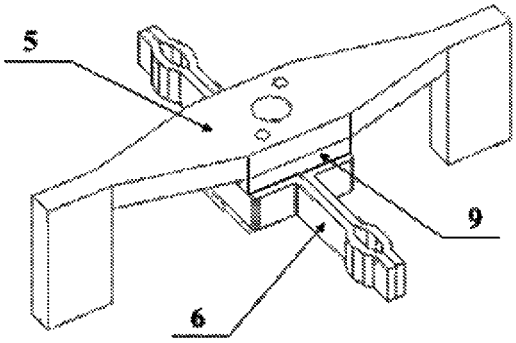
FIG. 5 is a schematic diagram of the three-dimensional structure of the armature and the movable springs of said present invention.
Figure 6:
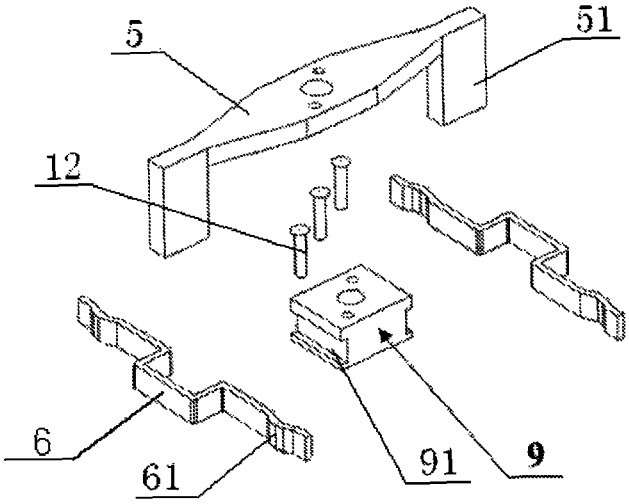
FIG. 6 is an exploded structure view of the armature and the movable springs of said present invention.

Referring to FIGS. 5 and 6, said armature 5, said movable spring 6 and said connecting block 9, a cross armature trigger structure. The cross armature trigger structure is centered at the connecting block 9 which is square, there are through-holes at the center of the connecting block 9 to install rotating shafts, and there are concave recesses 91 carved in surrounding walls of the connecting block 9, the shoulder-pole type armature 5 is fixed by rivets 12 and the connecting block 9, two bow-shaped metal sheets with arc-shaped protrusions 61 at the ends are used as the movable springs 6, and are fixed by the concave recesses 91, and external sides of the concave recesses 91 are symmetrically embedded into the side walls of the connecting block 9; the permanent magnet 8 is installed under the connecting block 9, and there are through holes to install rotating shafts at the center of said permanent magnet 8, the magnetizing polarity direction of the permanent magnet is consistent with the installation direction of the movable springs 6, and perpendicular to the direction of the armature 5; when the cross armature trigger structure moves, the permanent magnet 8 does not rotate along with it.

In the electromagnetic relay, a pair of normally open contacts consist of the movable springs 6 and a pair of the static springs 3 at a diagonal position, and a pair of normally closed contacts consist of said movable springs 6 and the other pair of the static springs 3 at the other diagonal position.

Operating principles of the present invention are:

The permanent magnetic flux produced by the permanent magnet 8 is transmitted to the pole surface 411, which is connected with the large yoke 41, along the large yoke 41 conducting magnetism, and then permanent magnetic attraction force is generated, and acts on the armature 5; when there is no currents on the terminal rods e, f, the armature 5 contacts with the pole surface 411 which connected with the yoke 4 by the action of permanent magnetic attraction force, and the movable spring 6 contacts with the static spring 3 which is connected with the terminal rods a, c, and the terminal rods e, f at a diagonal position are conducted to each other. When the forward current passes into the terminal rods e, f, the magnetic flux produced by the coils on the iron core and coil bobbin 2 is transmitted to the pole surface 421 which is connected with the small yoke 42 along the small yoke 42 conducting the magnetic flux, then a magnetic attraction force is generated, and acts on the armature 5. Similarly, an electromagnetic attraction force is generated at the small yoke 42 at the other side of the diagonal. When the magnetic attraction force acting on the armature 5 is stronger than the permanent magnetic attraction force, the armature 5 keeps turning till the armature 5 contacts with the pole surface 421 which is connected with small yoke 42, and then the whole cross armature trigger structure turns along with it and drives the movable spring 6 to contact with the static spring 3 which is connected with the terminal rods b, d, and then the terminal rods b, d are conducted to each other.

Said present invention is a novel-structure electromagnetic relay containing a permanent magnet. The base 11 is a foundation for disposing main components of the relay, and in the meantime to play a role of protecting a part of the housing 10. Multiple terminal rods 1 are respectively connected to the internal coils, and the touch-spring, in order to transmit signals, to generate magnetic potential and to fasten the device. The iron core of the iron core and the coil bobbin 2 is used for conducting magnetism, the coil bobbin 2 of the iron core and the coil bobbin 2 is used for supporting the coils. The static spring 3 is connected with the corresponding terminal rods 1, and then circuit switching and signal transmission are achieved by the movement of the movable spring 6. The pole surfaces 411 and 421, and the yoke 4 are used for conducting magnetism, and for generating attraction force, the armature 5 keep turns till the armature 5 contacts with the pole surface. The sealed housing 10 is airtight connected with the edges of the base 11, and then it achieves the function of protecting various components in the relay.

The above-mentioned is only preferred embodiments of the present invention, description and not intended to limit the invention. The ordinary technicians in this field can understand it as the following, any modification, equivalent replacement, improvement, etc of the present invention, where is within the spirit and principle, should be deemed to be within the scope of the present invention.

What is claimed is:

1. An electromagnetic relay containing a permanent magnet, which comprises a base and terminal rods, two iron cores and two coil bobbins, two pairs of static springs, pole surfaces and yokes, an armature, movable springs, a bracket, the permanent magnet, connecting blocks, a middle axis and a sealed housing, wherein at least three pairs of the terminal rods pass through the base which is rectangular, wherein, two pairs of the terminal rods are respectively connected to the lower ends of the four static springs, the two iron cores and the two coil bobbins are respectively installed near two ends of a diagonal of the upper surface of the base, terminals of wires which are twined around the two coil bobbins are respectively connected to the further third pair of the terminal rods, the two pairs of static springs are respectively mounted near two ends of the other diagonal of the upper surface of the base, the bracket is mounted at the top of the two coil bobbins, the pole surfaces and the yokes, and the permanent magnet are installed on the bracket; the armature, the movable springs, the pole surfaces and the yokes are located and connected by the middle axis, said middle axis is located in the center of the bracket, and the outside of the electromagnetic relay is covered by the sealed housing.

2. The electromagnetic relay containing a permanent magnet according to the claim 1, wherein, the structure of said pole surfaces and said yokes is: there are a pair of large yokes and a pair of pole surface each connected with a corresponding large yoke, each large yoke is connected with one pole surface, and there are a pair of small yokes and a pair of pole surface each connected with a corresponding small yoke, each small yoke is connected with the other pole surface, the pair of large yokes and the pair of small yokes are centrally symmetrically disposed on the bracket; the pole surface connecting with each large yoke and the pole surface connecting with each small yoke are disposed opposite to each other at a given distance, and downwardly bent ends at both ends of the armature are disposed within the distance between the former pole surface and the latter surface, the other end of each large yoke is butt jointed with one end of the permanent magnet and also connected to one pole surface, the other end of each small yoke is connected with the top of the two iron cores and the two coil bobbins.

3. The electromagnetic relay containing a permanent magnet according to the claim 1, wherein, said armature, said movable springs and said connecting block form a cross armature trigger structure, wherein the cross armature trigger structure is centered at the connecting block which is square, there are through-holes at the center of the connecting block to install rotating shafts, and there are concave recesses carved in surrounding walls of the connecting block, the armature is shoulder-pole shape, which is fixed by rivets and the connecting block, two bow-shaped metal sheets with arc-shaped protrusions at the ends are used as the movable springs, and are fixed by the concave recesses, external sides of which are symmetrically embedded into the side walls of the connecting block; the permanent magnet is installed under the connecting block, and there are through holes to install rotating shafts at the center of said permanent magnet, the magnetizing polarity direction of the permanent magnet is consistent with the installation direction of the movable springs, and perpendicular to the direction of the armature; when the cross armature trigger structure moves, the permanent magnet does not rotate along with it.

4. The electromagnetic relay containing a permanent magnet according to the claim 1, wherein, in the electromagnetic relay, a pair of normal open contacts consist of the movable springs and a pair of the static springs at a diagonal position, and a pair of normal closed contacts consist of said movable springs and the other pair of the static springs at the other diagonal position.

* * * * *